US008134108B2

(12) United States Patent
Sullivan et al.

(10) Patent No.: US 8,134,108 B2
(45) **Date of Patent: *Mar. 13, 2012**

(54) IMAGE INTENSIFYING DEVICE

(75) Inventors: Neal T. Sullivan, Lunenburg, MA (US); Anton Tremsin, Lafayette, CA (US); Ken Stenton, Lancaster, MA (US); Philippe De Rouffignac, Cambridge, MA (US)

(73) Assignee: Arradiance, Inc., Sudbury, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/151,086

(22) Filed: Jun. 1, 2011

(65) Prior Publication Data

US 2011/0226933 A1 Sep. 22, 2011

Related U.S. Application Data

(63) Continuation of application No. 12/421,603, filed on Apr. 9, 2009, now Pat. No. 7,977,617.

(60) Provisional application No. 61/043,993, filed on Apr. 10, 2008.

(51) Int. Cl.
*H01J 40/14* (2006.01)

(52) U.S. Cl. ..... 250/207; 250/214 VT

(58) Field of Classification Search ..... 250/207, 250/214 VT, 214 R, 208.1; 313/524, 528, 313/537, 105 CM, 542–544, 103 CM, 103 R, 313/106

See application file for complete search history.

(56) References Cited

U.S. PATENT DOCUMENTS

| | | | | |
|---|---|---|---|---|
| 3,777,201 | A * | 12/1973 | Einstein | 313/526 |
| 4,339,659 | A | 7/1982 | Johnson | |
| 4,555,731 | A | 11/1985 | Zinchuk | |
| 4,780,395 | A | 10/1988 | Saito et al. | |
| 4,912,314 | A | 3/1990 | Sink | |
| 5,205,902 | A | 4/1993 | Horton | |
| 5,319,189 | A | 6/1994 | Beauvais et al. | |
| 5,726,076 | A | 3/1998 | Tasker | |
| 6,452,184 | B1 | 9/2002 | Taskar | |
| 6,483,231 | B1 | 11/2002 | Iosue | |
| 6,667,472 | B2 | 12/2003 | Janeczko et al. | |
| 6,943,344 | B2 | 9/2005 | Cornish et al. | |
| 2002/0021064 | A1 | 2/2002 | Devoe | |
| 2002/0088714 | A1 | 7/2002 | Motoi et al. | |
| 2003/0214236 | A1 | 11/2003 | Kao et al. | |
| 2005/0184249 | A1 | 8/2005 | Suzuki | |

OTHER PUBLICATIONS

"Notification of Transmittal of the International Search Report and the Written Opinion of the International Searching Authority, or the Declaration", for PCT/US09/40127, Nov. 23, 2009, 13 pages, Korean Intellectual Property Office, Seo-gu, Daejeon, Republic of Korea.

(Continued)

*Primary Examiner* — Que T Le
(74) *Attorney, Agent, or Firm* — Kurt Rauschenbach; Rauschenbach Patent Law Group, LLP

(57) ABSTRACT

An image intensifying device includes a lens that is positioned at a light input that forms an image of a scene. The image intensifying device also includes an image intensifier tube that includes a photocathode that is positioned to receive the image formed by the lens. The photocathode generates photoelectrons in response to the light image of the scene. The image intensifier tube also includes a microchannel plate having an input surface comprising the photocathode. The microchannel plate receives the photoelectrons generated by the photocathode and generating secondary electrons. An electron detector receives the secondary electrons generated by the microchannel plate and generates an intensified image of the scene.

19 Claims, 2 Drawing Sheets

OTHER PUBLICATIONS

"Notification Concerning Transmittal of International Preliminary Report on Patentability (Chapter I of the Patent Cooperation Treaty)" for PCT/US2009/040127, Oct. 21 2010, 8 pages, the International Bureau of WIPO, Geneva, Switzerland.

"Notification Concerning Transmittal of International Preliminary Report on Patentability (Chapter I of the Patent Cooperation Treaty)" for PCT/US09/035012, Sep. 10, 2010, 7 pages, the International Bureau of WIPO, Geneva, Switzerland.

"Notification Concerning Transmittal of International Preliminary Report on Patentability (Chapter I of the Patent Cooperation Treaty)" for PCT/US09/035017, Sep. 10, 2010, 9 pages, the International Bureau of WIPO, Geneva, Switzerland.

"Notification of Transmittal of the International Search Report and the Written Opinion of the International Searching Authority, or the Declaration", for PCT/US09/047977, Apr. 23, 2010, 11 pages, International Searching Authority, Korean Intellectual Property Office, Seo-gu, Daejeon, Republic of Korea.

"Notification of Transmittal of the International Search Report and the Written Opinion of the International Searching Authority, or the Declaration", for PCT/US09/047950, Apr. 21, 2010, 11 pages, International Searching Authority, Korean Intellectual Property Office, Seo-gu, Daejeon, Republic of Korea.

Elam, Jeffrey, W. et al., Atomic Layer Deposition for the Conformal Coating of Nanoporous Materials, Journal of Nanomaterials, 2006, pp. 1-5, vol. 2006, Hindawi Publishing Corporation.

* cited by examiner

IMAGE INTENSIFYING DEVICE

CROSS-REFERENCE TO RELATED APPLICATIONS

The present application is a continuation of U.S. patent application Ser. No. 12/421,603, filed on Apr. 9, 2009 now U.S. Pat. No. 7,977,617, which claims priority to U.S. Provisional Patent Application Ser. No. 61/043,993, filed on Apr. 10, 2008. The entire contents of these patent applications are herein incorporated by reference.

INTRODUCTION

The present teaching relates to image intensifying devices, such as night vision devices. In some applications of image intensifying devices, the light being viewed is too dim to be seen with natural human vision. Also, in some applications of image intensifying devices, the image being viewed is illuminated only by infrared light which is invisible to human vision. On nights that are too dark for natural human vision, invisible infrared light is provided by the stars of the night sky that is in the near-infrared portion of the electromagnetic spectrum. Infrared light is electromagnetic radiation having a wavelength that is longer than the wavelength of visible light, but shorter than the wavelength of microwave radiation.

Light amplification devices can amplify invisible infrared light and near-infrared light to generate an image which is visible to the human eye that replicates a low-light or night-time scene. Such night vision devices typically include an objective lens which focuses low-light or invisible infrared light from the low-light or night-time scene through a transparent light-receiving face of an image intensifier tube. The image intensifying devices provides a visible image that is often in the yellow-green portion of the electromagnetic spectrum. This image is then provided to the user by various means.

Image intensifying devices, such as night vision devices, typically use an image intensifier tube to amplify light from the surrounding image. The image intensifier tube amplifies the image from the scene and also shifts the wavelength of the image into the portion of the spectrum that is visible to the human eye, thus providing a visible image to the user that replicates the viewed scene.

Image intensifying devices typically include a photocathode downstream of the light input of the device that receives the low-light or night time image. The photocathode generates photoelectrons when photons of visible and infrared light impact the active surface of the photocathode. The photoelectrons are generated by the photocathode in a pattern which replicates the scene being viewed. These photoelectrons are then moved by an electrostatic field provided by a power supply, such as a battery, to microchannel plates (MCPs) having numerous microchannels, where each of the microchannels functions as a dynode.

The microchannel plates are used to detect very weak electrical signals generated by the photocathode. A microchannel plate is a slab of high resistance material having a plurality of tiny tubes or slots, which are known as microchannels, extending through the slab. The microchannels are positioned parallel to each other and may be positioned at a small angle to the surface. The microchannels are usually densely distributed. A high resistance layer having high secondary electron emission efficiency is formed on the inner surface of each of the plurality of microchannels so that it functions as a dynode. A conductive coating is formed on the top and bottom surfaces of the slab comprising the microchannel plate.

In operation, an accelerating voltage is applied across the conductive coatings on the top and bottom surfaces of the microchannel plate with a power source, such as a battery. The accelerating voltage establishes a potential gradient between the opposite ends of each of the plurality of channels. Electrons and ions traveling in the plurality of channels are accelerated. These electrons and ions collide against the high resistance layer having high secondary electron emission efficiency, thereby producing secondary electrons. The secondary electrons are accelerated and undergo multiple collisions with the resistance layer. Consequently, electrons are multiplied inside each of the plurality of channels.

In other words, each time an electron (whether a photoelectron or a secondary-emission electron previously emitted by the microchannel plate) collides with the material on the interior surface of the microchannels, more than one electron (i.e., secondary-emission electrons) leaves the site of the collision. The electrons eventually pass through the anode end of each of the plurality of channels. As a consequence, the photoelectrons entering the microchannels cause a geometric cascade of secondary-emission electrons moving along the microchannels, from one face of the microchannel plate to the other so that a spatial output pattern of electrons is produced by the microchannel plate.

The pattern of electrons replicates the input pattern of photons, but the electron density can be several orders of magnitude higher than the density of photons. This pattern of electrons is moved from the microchannel plate to a phosphorescent screen electrode by another electrostatic field. When the electron shower from the microchannel plate impacts on and is absorbed by the phosphorescent screen electrode, visible-light phosphorescence occurs in a pattern which replicates the image. This visible-light image is passed out of the tube for viewing via a transparent image-output window.

BRIEF DESCRIPTION OF THE DRAWINGS

The present teachings, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teachings in any way.

DETAILED DESCRIPTION

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

Figure 1:
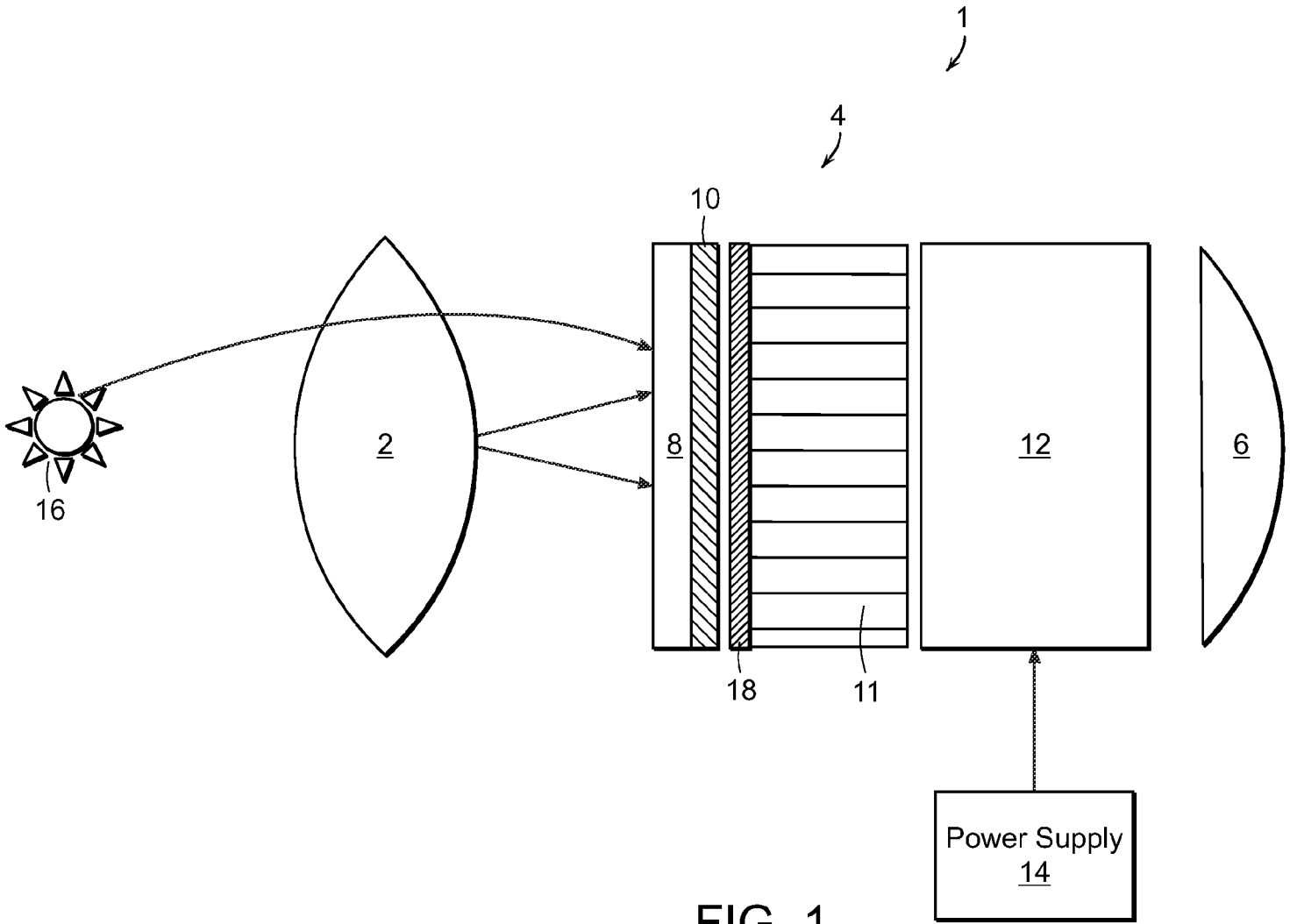
FIG. 1 illustrates a prior art image intensifying device.

FIG. 1 illustrates a prior art image intensifying device 1. The image intensifying device 1 includes an optical input element 2 that directs and focuses light from a scene 16 being viewed into the device 1. The optical input element 2 can be any type of imaging device, such as an objective lens assembly and a mirror. An image intensifier tube 4 is positioned adjacent to the optical input element 2. The image intensifier tube 4 includes a cathode window 8. The cathode window 8 is a glass plate having a photocathode coating 10 deposited on its interior surface. The photocathode coating 10 is designed to convert photons passing through the glass plate of the cathode window 8 to electrons. For example, the photocathode coating 10 can be a gallium arsenide coating.

The image intensifier tube 4 also includes a microchannel plate 11 that is positioned proximate to the cathode window 8. Microchannel plates are well known in the art. Some microchannel plates include a glass assembly of hollow pores having electron conduction and amplification properties. Other microchannel plates are formed of semiconductor materials. The surface of the microchannel plate 11 that is adjacent to the cathode window 8 is coated with a thin insulating layer 18 that forms a barrier to the transmission of ions back to the photocathode coating 10. For example, the surface of the microchannel plate 11 adjacent to the cathode window 8 can be coated with a layer of $Al_2O_3$ or $SiO_2$ that is less than about 10 nm thick.

A phosphor screen 12 is positioned adjacent to the microchannel plate 11. The phosphor screen 12 can be a fiber optic bundle with a phosphor coating on the input optical surfaces. The phosphor screen 12 converts electrons emitted by the microchannel plate into a visible image. A power supply 14 is electrically connected to the active components of the image intensifying device 1, such as the cathode window 8, the microchannel plate 11, and the phosphor screen 12. The power supply 14 typically needs to supply several different voltages levels and typically provides relatively high voltage with relatively low current. The power supply 14 can be a battery with at least one D.C. to D.C. converter that provides various voltage levels to the cathode window 8, the microchannel plate 11, and the phosphor screen 12 that are required for optimal performance.

In addition, the image intensifying device 1 includes at least one optical utilization element 6 that provides an image of the scene 16 being viewed to the user. For example, the optical utilization element 6 can be an eyepiece that allows viewing by the user. The optical utilization element 6 can also be a photodetector array. Also, the optical utilization element 6 can be a recording medium, such as a photographic film or a video recording media.

In operation, light from the scene 16 being viewed, which can be a low-level visible light and/or infrared light, is focused by the optical input element 2 through the glass plate in the cathode window 8 onto the photocathode 10. The photocathode 10 converts the light striking the photocathode 10 into electrons. The electrons travel into the microchannel plate 11 and are then multiplied by the emissive surfaces in the microchannel plate 11. The resulting electrons strike the phosphor screen 12. The phosphor screen 12 then converts the electrons generated by the microchannel plate 11 into visible light that can be viewed by the user. The image from the phosphor screen 12 is viewed with the optical utilization element 6 which can be a simple eyepiece or some type of photographic or video recording medium.

One undesirable feature of the conventional image intensifying devices is that the electrostatic fields established in the image intensifier tube 4 that transport the electrons from the photocathode coating 10 to the phosphor screen 12 are also effective to transport positive ions present within the image intensifier tube 4 back towards the photocathode coating 10. Because such positive ions may include the nucleus of gas atoms of considerable size, such as the nucleus of hydrogen, oxygen, and nitrogen, which are much more massive than an electron, these positive gas ions are capable of causing physical impact damage and chemical damage to the photocathode coating 10.

In addition, gas atoms present within the image intensifier tube 4 that are electrically neutral may chemically combine with and poison the photocathode coating 10. The pore walls of known microchannel plates are a significant source of such electrically neutral gas atoms. Many conventional image intensifier tubes have a relatively high population of gas atoms within the image intensifier tube 4. Thus, the gas atoms which ionize to positive ions, and the much more populous atoms that remain electrically neutral, cause significant physical impact and chemical damage to the photocathode coating 10. This physical impact and chemical damage greatly reduces the operating lifetime of the image intensifying device.

State-of-the-art image intensifying devices position an ion barrier film 18 on the inlet side of the microchannel plate 11 that blocks or reduces the number of ions impacting the photocathode coating 10. The ion barrier film 18, referred to herein as a conventional prior art ion barrier, also reduces the probability of the occurrence of chemical reactions on the surface of the photocathode coating 10 by inhibiting the migration of chemically active atoms toward the photocathode coating 10.

However, a disadvantage of the ion barrier film 18 is that there is a decrease in the effective signal-to-noise ratio of the signal generated by the microchannel plate 11 because the relatively low energy electrons are absorbed by the ion barrier film 18. Secondary-emission electrons typically have relatively low energy that can be low enough to cause a significant fraction of the secondary electrons to be absorbed by the ion barrier film 18. In many currently used microchannel plates, the fill factor is about 50%. That is, in many microchannel plates, about half of the microchannel plate input is open area and the other half of the microchannel plate is defined by the solid portion or web material of the microchannel plates. Therefore, in these microchannel plates, about half of the photoelectrons impact on the web material.

Moreover, the photoelectrons that impact the web of the microchannel plate 11 cause the production of secondary emission electrons adjacent to the open areas of the microchannel plate 11. These secondary emission electrons have relatively low energies that lack the energy to either penetrate the ion barrier film, or to cause the film to liberate secondary electrons. Consequently, these low energy electrons are absorbed by the ion barrier film 18. The result is that, in some cases, as much as 50% of the electrons that would otherwise contribute to the formation of an image by the image intensifier tube 4 are blocked or absorbed by the ion barrier film 18 and do not reach the microchannels to be amplified. Thus, about 50% of the image information may be lost, which results in a low sensitivity device.

The ion barrier film 18 can compensate for the loss resulting from the absorption of some of the electrons by providing some secondary electron emissivity. That is, the ion barrier film 18 itself can be a secondary emitter of electrons. However, the number of secondary electrons emitted is not significant because the secondary electron emissivity of the ion barrier film 18 is typically relatively low. Therefore, the ion barrier film 18 will only generate secondary electrons if the electrons impacting the ion barrier film 18 have optimized energy. Typically, the secondary electron emission from the ion barrier film 18 does not fully compensate for the electrons impacting the ion barrier film 18.

Another disadvantage of using an ion barrier film 18 in an image intensifier tube 4 is that it can contribute to forming a halo or emission of light around the image of the scene 16 being viewed. This halo is caused by the fact that photoelectrons incident on the web of the microchannel plate 11 or incident on the ion barrier film 18 do not penetrate the ion barrier film 18. Instead, these backscattered photoelectrons impact the film or the web at another location. These backscattered photoelectrons decrease the signal and increase the noise, thereby causing the halo around the image of the scene 16 being viewed.

The halo or emission of light around the image of the scene 16 being viewed also results from the physical distance between the photocathode coating 10 on the cathode window 8 and the front face of the microchannel plate 11. In many conventional image intensifying devices, there is a significant gap between the photocathode coating 10 and the front face of the microchannel plate 11 that is on order of about 250μ. It is well known in the art that such gaps contribute to forming a halo image around the scene 16 being viewed. The halo around the image of the scene 16 being viewed does not correspond to a bright area of the scene 16. Therefore, the halo around the image reduces the quality of the image provided by the image intensifier tube 4 and also reduces contrast values in the image, therefore limiting the resolution of the image.

Another disadvantage of using an ion barrier film 18 in the image intensifier tube 4 is that a higher voltage must be applied to the image intensifier tube 4 between the glass plate having a photocathode coating 10 and the microchannel plate 11. The higher voltages are necessary to overcome the electron barrier established by the ion barrier film 18. For example, an additional 600 to 700 volts may be required to overcome the electron barrier established by the ion barrier film 18. Consequently, a larger physical spacing between the glass plate having the photocathode coating 10 and the microchannel plate 11 will be necessary to prevent an electrical discharge. These larger spacing will result in a more pronounced halo or emission of light around the image of the scene 16.

Another undesirable feature of conventional image intensifying devices is that the photocathode coating 10 is transmissive. Transmissive photocathode coatings are difficult to optimized for efficiency. Transmissive photocathode coatings must be thick enough so that photoelectrons are generated with high efficiency, but thin enough for the photoelectrons to escape through the other side of the photocathode coating 10 to the microchannel plate 11. It is therefore, difficult, if not impossible, to achieve the maximum quantum efficiency of the photocathode in known image intensifying devices.

An image intensifying device according to the present teaching has a reduced probability of photocathode poisoning and, therefore, an improved lifetime compared with known devices. The reduced photocathode poisoning is achieved without the use of a conventional prior art ion barrier film and, therefore, does not have a reduced signal-to-noise ratio and can have a very low level of halo image. Furthermore, an image intensifying device according to the present teaching has relatively high quantum efficiency performance.

An image intensifier device according to one embodiment of the present teaching has an image intensifier tube with an integrated photocathode that is directly deposited onto a surface of the microchannel plate. The image intensifier tube can be formed in a high temperature substrate. In one aspect of the present teaching, the properties of the microchannel plate, such as the microchannel plate substrate, the resistive film, and the emissive film are optimized to eliminate or to suppress ions, thereby reducing photocathode poisoning and improving the image intensifier device quantum efficiency performance and lifetime. For example, the image intensifier tube can include emissive and resistive films that can act as a barrier to or minimally contain gaseous ions, such as H, $CO_2$, $H_2O$, and N gases, which are the typical sources of the photocathode poisoning.

Figure 2:
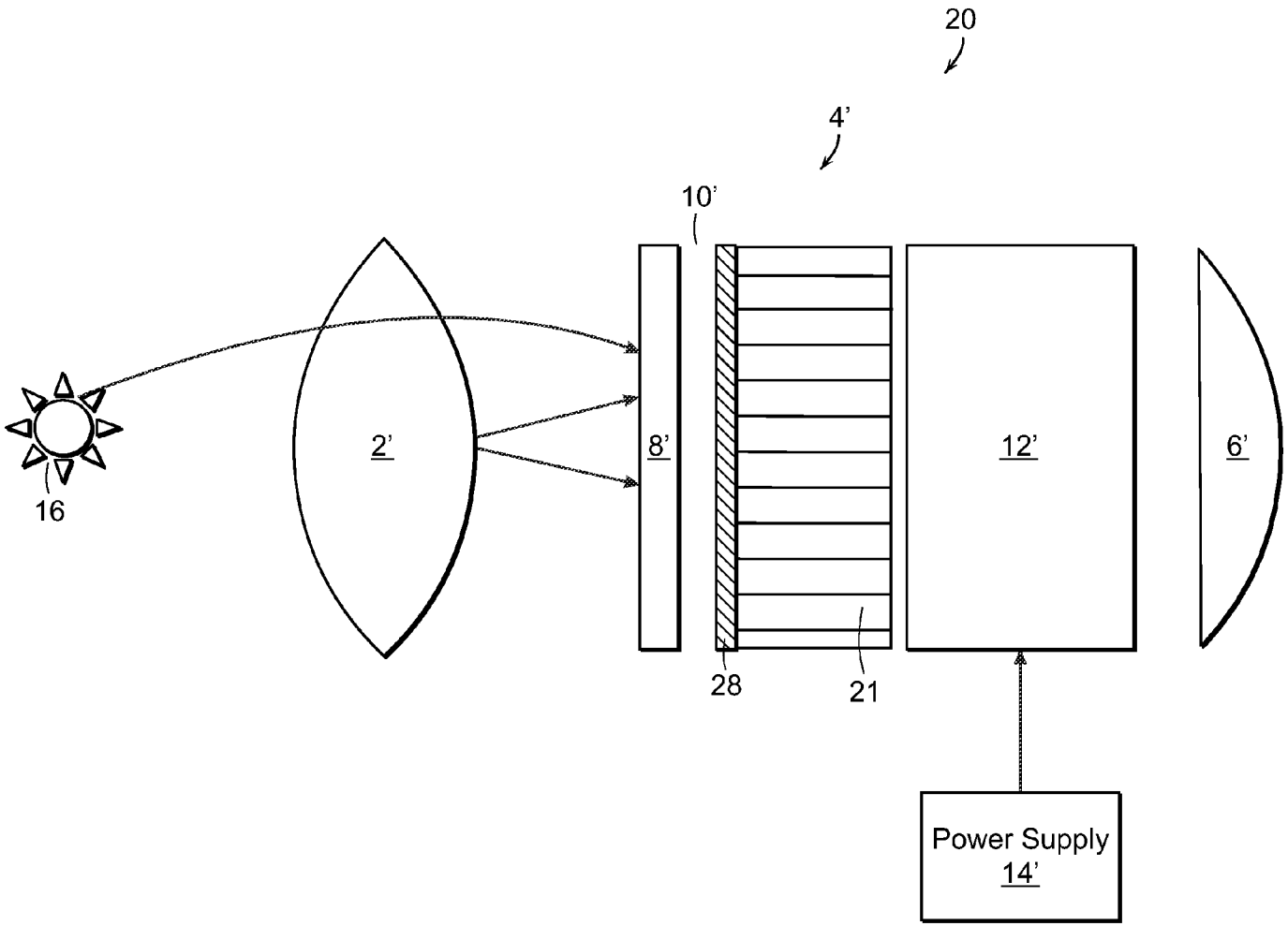
FIG. 2 illustrates an image intensifying device including an image intensifier tube with an integrated photocathode and microchannel plate according to the present teaching.

FIG. 2 illustrates an image intensifying device 20 including an image intensifier tube 4' with an integrated photocathode 28 and microchannel plate 21 according to the present teaching. The image intensifying device 20 includes an optical input element 2' that directs and focuses light from the scene 16 being viewed into the image intensifying device 20. The optical input element 2' can be any type of imaging device, such as an objective lens assembly and a mirror. An image intensifier tube 4' is positioned adjacent to the optical input element 2'.

The image intensifier tube 4' includes a cathode window 8'. The cathode window 8' is a plate that is formed of a medium that is transparent to the visible and infrared radiation. For example, the cathode window 8' can be a glass plate. The cathode window 8' in the image intensifying device 20 is a transparent medium that encloses the light input end of the image intensifier tube 4' so that a vacuum can be maintained in the image intensifier tube 4'.

In contrast to the cathode window 8 that is described in connection with the prior art image intensifying device 1 shown in FIG. 1, the cathode window 8' does not include a photocathode coating on the inner surface of the window. Instead, the image intensifying device 20 integrates the photocathode 28 into the input window of the microchannel plate 21. In some embodiments, the photocathode 28 is deposited directly onto the cathode window 8'.

Thus, image intensifying devices according to the present teaching having a photocathode 28 integrated directly into the input of the microchannel plate 21. Such a device structure overcomes or reduces the severity of many of the disadvantages of the prior art image intensifying devices. For example, integrating the photocathode 28 directly into the input of the microchannel plate 21 reduces the probability of photocathode poisoning and, therefore, improves the device lifetime compared with known devices. Also, integrating the photocathode 28 directly into the input of the microchannel plate 21 maintains a high signal-to-noise ratio and can result in a very low level of halo image. Furthermore, integrating the photocathode 28 directly into the input of the microchannel plate 21 results in a relatively high quantum efficiency performance.

Furthermore, integrating the photocathode 28 directly into the input of the microchannel plate 21 maintains a low energy barrier to introducing electrons into the microchannel plate 21. The low energy barrier is maintained because the microchannels in the microchannel plate 21 are open in the direction facing the photocathode 28. That is, there is no ion barrier film present to restrict electron entry.

Thus, the photoelectrons generated by the photocathode 28 have no energy barrier to overcome. This is in contrast to many conventional proximity focused image intensifier tubes which include an ion barrier film on the input side of the microchannel plate. In these conventional image intensifier tubes, the electrons must effectively penetrate the ion barrier to get into the microchannels. Consequently, the voltage applied to the photocathode 28 of the image intensifier tube 4' should be lower than the voltage applied to other state-of-the art image intensifier tubes while still providing an adequate level of applied electric field, and while also still providing an adequate flow of photoelectrons to the microchannel plate 21. Therefore, the spacing between the cathode window 8' and the microchannel plate 21 can be significantly reduced, which results in physically smaller devices and less expensive voltage power supplies.

Numerous types of microchannel plates can be used with the image intensifying device of the present teaching. For example, one type of microchannel plate that can be used with the image intensifying device of the present teaching is fabricated by forming a plurality of small holes in a glass plate. See for example, the glass plate microchannels described in Microchannel Plate Detectors, Joseph Wiza, Nuclear Instruments and Methods, Vol. 162, 1979, pages 587-601.

Another type of microchannel plate that can be used with the image intensifying device of the present teaching is a silicon microchannel plate. See, for example, U.S. Pat. No. 6,522,061B1 to Lockwood, which is assigned to the present assignee. Silicon microchannel plates have several advantages compared with glass microchannel plates. Silicon microchannel plates can be more precisely fabricated because the pores can be lithographically defined rather than manually stacked like glass microchannel plates. Silicon processing techniques, which are very highly developed, can be applied to fabricating such microchannel plates. Also, silicon substrates are much more process compatible with other materials and can withstand high temperature processing. Furthermore, silicon microchannel plates can be easily integrated with other devices, such as the integrated photocathode 21. One skilled in the art will appreciate that the substrate material can be any one of numerous other types of semiconductor and insulating substrate materials.

Thus, in one embodiment, the microchannel plate 21 is formed of a high temperature insulating substrate. The microchannel plate 21 substrate is coated with a high temperature resistive and emissive film that provides the desired resistance and secondary electron emissivity for electron multiplication as well as purity for reduced ion contamination. Coating the substrate with a high temperature resistive and emissive film with high purity greatly reduces the number of electrically neutral gas atoms originating from the pore walls. In some embodiments, the resistive and emissive film in the microchannel plate 21 substrate also has the desirable ion barrier properties. The resistive and emissive film can comprise one or more films.

For example, the resistive and emissive film can be a metal oxide thin film, such as $Al_2O_3$, MgO, and $NiO_2$. The metal oxide thin film can be a single layer film or a nanolaminate of multiple metal oxide thin film layers. In various embodiments, the nanolaminates of multiple metal oxide thin film layers can include layers of materials, such as $Cu_2O$, CuO, ZnO, and $SnO_2$. For example, the resistive and emissive film in the microchannel plate 21 substrate can include nanolaminate structures having at least one of $ZrO_2$, $HfO_2$, $SiO_2$, $Al_2O_3$, $NiO_2$, $Cu_2O$, CuO, ZnO, and $SnO_2$ films. Also, in some embodiments, the resistive and emissive film can be a nanoalloy with various doping elements. See, for example, U.S. patent application Ser. No. 12/143,732, entitled "Microchannel Plate Devices with Tunable Conductive Films," which is assigned to the present assignee. The specification of U.S. patent application Ser. No. 12/143,732 is incorporated herein by references.

In some embodiments of the image intensifying device of the present teaching, the microchannel plate 21 includes multiple emissive layers. In various embodiments, each of the multiple emissive layers can comprise at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N4$, $Si_xO_yN_z$, C (diamond), BN, and AlN. Using a second (or more than two) emissive layers can greatly increase the secondary electron emission efficiency of the microchannel plate. See, for example, U.S. patent application Ser. No. 12/038,254, entitled "Microchannel Plate Devices with Multiple Emissive Layers," and U.S. patent application Ser. No. 12/038,139, entitled "Method of Fabricating Microchannel Plate Devices With Multiple Emissive Layers" which are both assigned to the present assignee. The specifications of U.S. patent application Ser. Nos. 12/038,254 and 12/038,139 are incorporated herein by references.

In embodiments that include multiple emissive layers, the thickness and material properties of the second emissive layer or multiple emissive layers are generally chosen to increase the secondary electron emission efficiency of the microchannel plate compared with conventional microchannel plates fabricated with single emissive layers. In some embodiments, the thickness and material properties of the second emissive layer, or multiple emissive layers, are also chosen to provide a barrier to ion migration. In these embodiments, a separate ion barrier layer is not necessary. In other embodiments, an ion barrier material is positioned between the first and the second emissive layer to reduce the possibility of ions traveling back to the photocathode 28, thereby increasing the lifetime of the image intensifying device.

In yet other embodiments, an image intensifying device according to the present teaching includes a microchannel plate with multiple emissive layers that do not require an ion barrier in geometries where the photocathode is not formed directly on the input surface of the microchannel plate. One skilled in the art will appreciate that there are many possible configurations.

EQUIVALENTS

While the present teachings are described in conjunction with various embodiments and examples, it is not intended that the present teachings be limited to such embodiments. On the contrary, the present teachings encompass various alternatives, modifications and equivalents, as will be appreciated by those of skill in the art, may be made therein without departing from the spirit and scope of the teaching.

What is claimed is:

1. An image intensifying device comprising:

a. a lens that is positioned at a light input, the lens forming an image of a scene;

a. an image intensifier tube comprising:

i. a photocathode that is positioned to receive the image of the scene formed by the lens, the photocathode generating photoelectrons in response to the image of the scene; and ii. a microchannel plate comprising an input surface positioned adjacent to the photocathode and separated by a predetermined distance, and at least one of a substrate, an emissive film, and a resistive film that suppresses the generation of ions, the microchannel plate receiving the photoelectrons generated by the photocathode and generating secondary electrons; and b. an electron detector that receives the secondary electrons generated by the microchannel plate and generates an intensified image of the scene.

2. The image intensifying device of claim 1 wherein the microchannel plate comprises a reduced lead-glass microchannel plate.

3. The image intensifying device of claim 1 wherein the microchannel plate comprises a semiconductor microchannel plate.

4. The image intensifying device of claim 1 wherein the microchannel plate substrate is formed of at least one of $Al_2O_3$, Silicon, $SiO_2$, plastic, and $Si_3N_4$.

5. The image intensifying device of claim 1 wherein the microchannel plate comprises a first and a second emissive layer, the second emissive layer increasing the secondary electron emission efficiency of the microchannel plate.

6. The image intensifying device of claim 5 wherein the second emissive layer in the microchannel plate comprises at least one of $Al_2O_3$, MgO, and $NiO_2$.

7. The image intensifying device of claim 5 wherein the microchannel plate further comprises an ion barrier layer that is positioned between the first and the second emissive layer.

8. The image intensifying device of claim 1 wherein the microchannel plate further comprises an ion barrier layer.

9. The image intensifying device of claim 1 wherein the microchannel plate comprises: a substrate defining a plurality of pores extending from a top surface of the substrate to a bottom surface of the substrate, the plurality of pores having a resistive material on an outer surface that forms a resistive layer; and an emissive layer formed over the resistive layer, the emissive layer being chosen to achieve at least one of an increase in secondary electron emission efficiency and a decrease in gain degradation as a function of time.

10. The image intensifying device of claim 1 wherein the microchannel plate comprises a resistive film comprising at least one of $Cu_2O$, CuO, ZnO, and $SnO_2$.

11. The image intensifying device of claim 1 wherein the microchannel plate comprises an emissive film comprising at least one of $Al_2O_3$, MgO, and $NiO_2$.

12. The image intensifying device of claim 1 wherein the electron detector comprises at least one of a phosphor screen and a charge coupled device.

13. An image intensifying device comprising:

a. a microchannel plate having an input window for receiving an image of a scene, the microchannel plate comprising at least one of a substrate, an emissive film, and a resistive film that suppresses the generation of ions;

b. a photocathode that is positioned adjacent to the input window of the microchannel plate and separated by a vacuum gap, the photocathode generating photoelectrons in response to the received image of the scene, the microchannel plate generating secondary electrons in response to the generated photoelectrons; and c. an electron detector that receives the secondary electrons generated by the microchannel plate and that generates an intensified image of the scene.

14. The image intensifying device of claim 13 wherein the microchannel plate comprises a reduced lead-glass microchannel plate.

15. The image intensifying device of claim 13 wherein the microchannel plate comprises a semiconductor microchannel plate.

16. The image intensifying device of claim 13 wherein the microchannel plate comprises a first and a second emissive layer, wherein the second emissive layer increases the secondary electron emission efficiency of the microchannel plate.

17. The image intensifying device of claim 16 wherein the microchannel plate further comprises an ion barrier layer that is positioned between the first and the second emissive layer.

18. The image intensifying device of claim 13 wherein the microchannel plate further comprises an ion barrier layer.

19. An image intensifying device comprising:

a. a photocathode that is formed directly on a cathode window, the photocathode generating photoelectrons in response to an image of a scene, b. a microchannel plate having an input surface for receiving photoelectrons generated by the photocathode and being positioned adjacent to the photocathode and spaced from the photocathode by a vacuum gap, the microchannel plate comprising at least one of a substrate, an emissive film, and a resistive film that suppresses the generation of ions, the microchannel plate generating secondary electrons in response to the generated photoelectrons; and c. an electron detector that receives the secondary electrons generated by the microchannel plate and that generates an intensified image of the scene.

* * * * *